United States Patent [19]

Rand

[11] 4,076,263

[45] Feb. 28, 1978

[54] BALL SKATE

[76] Inventor: Robert K. Rand, 929 Falls Church Road, Matthews, N.C. 28105

[21] Appl. No.: 633,639

[22] Filed: Nov. 20, 1975

Related U.S. Application Data

[63] Continuation-in-part of Ser. No. 565,144, April 4, 1975, abandoned.

[51] Int. Cl.[2] ..... A63C 17/24

[52] U.S. Cl. ..... 280/11.1 BR; 301/5 R

[58] Field of Search ..... 280/11.1 BR, 11.1 BT, 280/11.1 R; 301/5 R, 5.3, 5.7; 308/210, 211; 16/24, 25, 27

[56] References Cited

U.S. PATENT DOCUMENTS

| | | | |
|---|---|---|---|
| 196,024 | 10/1877 | Konz | 16/27 |
| 904,088 | 11/1908 | Rother | 280/11.1 BR |
| 1,224,294 | 5/1917 | Franzen | 16/27 |
| 1,616,442 | 2/1927 | De Festenburg et al. | 280/11.1 BR |
| 3,310,320 | 3/1967 | Hanna et al. | 280/87.04 A |
| 3,387,852 | 6/1968 | De Sarro | 280/11.2 |

FOREIGN PATENT DOCUMENTS

| | | | |
|---|---|---|---|
| 199,208 | 8/1938 | Switzerland | 280/11.1 BR |
| 533,957 | 2/1941 | United Kingdom | 280/11.1 BR |

*Primary Examiner*—Joseph F. Peters, Jr.

*Assistant Examiner*—David M. Mitchell

*Attorney, Agent, or Firm*—Morse, Altman, Oates & Bello

[57] ABSTRACT

Skates employing balls as the primary rolling elements may be used in lieu of roller skates for street hockey or indoors on wood floors, concrete or other hard surfaces. In the preferred form the skate includes two balls, preferably of semi-hardened rubber, metal, wood, plastic or the like, one in the front and one at the rear of the skate. Each ball is supported by a set of rolling supports which allow the ball to rotate freely in a forward or backward direction but inhibits rotation of the ball in other directions. The supports include at least two transverse shafts on which are mounted spaced rollers or rings of different diameters and contoured to mate with the upper portion of the ball. The different size rollers are independently rotatable on the shaft to compensate for the different surface speeds of the ball as it rolls forwards or backwards. Since the rollers can rotate only about the transverse axis of the shaft, the friction produced between the ball and the supports in a direction other than forwards and backwards inhibits sidewise movement of the skate. A pusher block is provided at the forward end of the skate allowing the wearer to push himself forwardly either by tipping the block against the skating surface or by a sidewise pushing motion much like an ice skate.

10 Claims, 6 Drawing Figures

BALL SKATE

CROSS-REFERENCE TO RELATED APPLICATION

This is a continuation-in-part of U.S. Patent Application Ser. No. 565,144, filed Apr. 4, 1975 and now abandoned.

BACKGROUND OF THE INVENTION

1. Field of the Invention

This invention relates generally to skates and more particularly is directed toward a new and improved ball skate for use on streets, sidewalks, floors and similar surfaces.

2. Description of the Prior Art

Standard roller skates usually involve four metal or hard rubber rollers on each skate and have been used for many years for both indoor and outdoor rollerskating activities. While rollerskating has been a popular pastime, the skates employed have not been capable of the same movements that are possible with conventional ice skates on ice. Generally speaking, roller skates function with all four rollers engaging the floor, pavement, etc., limiting the wearer to a somewhat flat-footed action. While it has been proposed heretofore to employ balls in lieu of the rollers as the primary rolling elements, such ball skates have utilized either simple sockets or ball bearings to support larger balls. This arrangement has been objectionable from the standpoint of too much overall friction or too little directional control so that the balls are free to move in any direction. Such unlimited of movement of the ball would make the skates difficult to control.

Accordingly, it is an object of the present invention to provide ball skates which are easy to control and function in a manner much like that of conventional ice skates. Another object of this invention is to provide a pair of ball skates of simple, low cost construction and which offer freedom of movement backwards and forwards but inhibit sideways movement thereof.

DETAILED DESCRIPTION OF THE PREFERRED EMBODIMENTS

Figure 1:
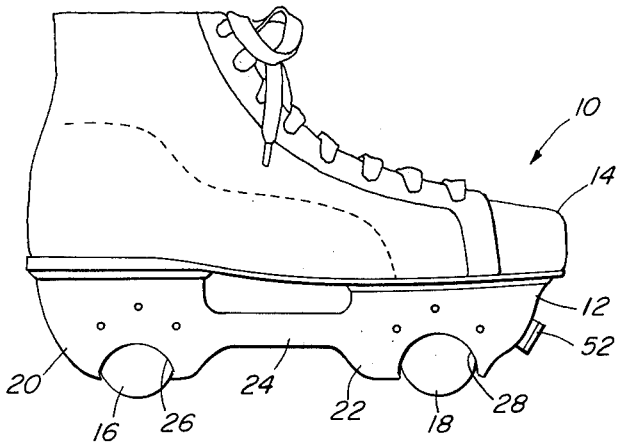
FIG. 1 is a view in side elevation of a ball skate made according to the invention.
Figure 2:
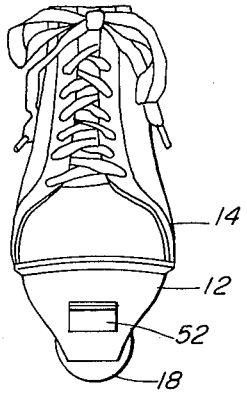
FIG. 2 is a view in front elevation thereof.

Referring now to the drawings and to FIG. 1 and 2 in particular, the reference character 10 generally indicates a ball skate made according to the invention and comprised of a skate frame housing 12 attached to the sole of a shoe 14. The skate frame housing 12, while shown permanently attached to the shoe 14, may be made available for detachable connection to conventional shoes by means of clamps, straps, etc., in a manner similar to that employed in children's roller skates. In any event, the skate frame housing 12 is provided with a pair of riding balls 16 and 18 mounted to the rear and forward portions, respectively, to ride against a hard, frictional surface such as a street, sidewalk, floor or the like. In practice, the balls 16 and 18 are preferably about the size of a standard golf ball, and while they may be made from a variety of materials, a somewhat hardened rubber with a frictional outer surface may be employed to provide a good rolling action with desirable surface friction characteristics to enhance control and provide long wear. Other satisfactory materials include hardwoods, metal or plastics such as urethanes that may be used with a filler. The balls preferably are solid and may be of the same material throughout or may be a composite material such as a wound and coated golf ball. The balls may be formed with smooth surfaces or sightly dimpled or otherwise patterned to improve traction. Typically, the diameter of the balls may be on the order of 1" to 2" more or less, by way of example.

The housing 12, in the illustrated embodiment, is comprised of rearward and forward socket portions 20 and 22, respectively, joined by a medial portion 24. Both socket portions are hollow and formed with arcuate bottom openings 26 and 28 through which the lower portions of the balls 16 and 18 extend. The openings 26 and 28 are slightly smaller than the balls 16 and 18 in order to retain the balls within the socket whenever the wearer lifts his foot. The openings 26 and 28 are cut away about their sides in order to allow the wearer to tilt his foot sideways thereby enhancing freedom of action. To reduce friction should the ball contact the edge of the socket openings, a coating of Teflon or the like may be applied about the socket edge.

Figure 3:
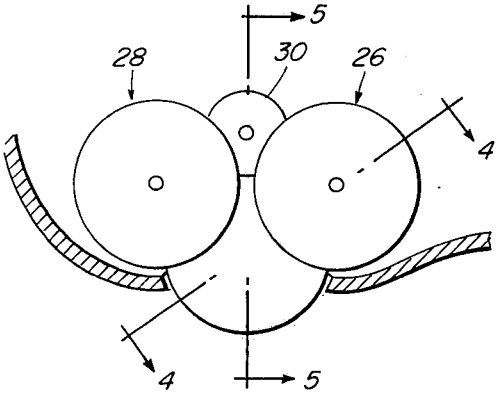
FIG. 3 is a detailed sectional side view of the rear ball and roller support.
Figure 4:
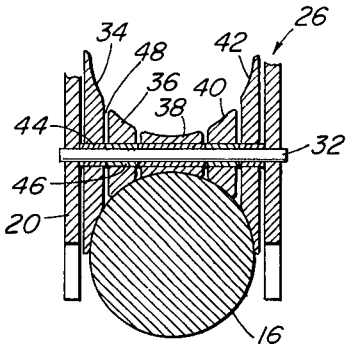
FIG. 4 is a cross-sectional view taken along the line 4—4 of FIG. 3.
Figure 5:
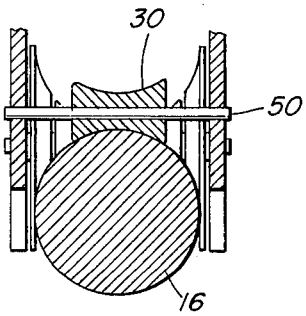
FIG. 5 is a cross-sectional view taken along the line 5—5 of FIG. 3.

Each ball 16 and 18 is supported within its respective socket by means of a set of rollers. Insofar as both sets of rollers are indentical only one set will be described. As best shown in FIGS. 3, 4 and 5, each ball is nested within a set of roller supports including a front roller support 26 located above and forwardly of the ball, a rear roller support 28 located above and rearwardly of the ball and an optional center roller support 30 located directly above the ball. The front and rear roller supports 26 and 28 are identical so that only one will be described. As best shown in FIG. 4, the rolling support 26 includes a shaft 32 extending transversely through the housing and is attached at its ends to the housing wall of the rear socket 20. The shaft may be fixed or mounted in bearings, as desired. The shaft 32 is spaced from the ball 16 and carries a plurality of axially spaced rings 34, 36, 38, 40 and 42. Each ring is free to rotate independently of the other rings and each ring is mounted on its own sleeve bearing 44, 46, etc. Each sleeve is slightly wider than the width of the ring to which it is attached in order to form an annular clearance 48 between the adjacent rings. The outer periphery of each ring is profiled to correspond with the curvature of that portion of the ball 16 where it engages the ball. This configuration is best shown in FIG. 4 where the center ring 38 is relatively small in diameter and engages the top portion of the ball 16. The rings outboard therefrom are of progressively greater diameter insofar as they engage different sections of the ball. The reason for employing rings of different diameters is that different parts of a rotating ball will experience different surface speeds. For example, if the ball skate is being rolled forwardly the top and bottom surface of the ball furthest from the axis of rotation will be moving at a greater speed than those portions of the ball nearer the axis of rotation. Thus, if the rings were not independently rotatable from one another, the ball would bind under the friction developed between the different portions of the ball and the rings. By employing the spaced rings in the manner shown, the ball is free to rotate forward and backward, is evenly supported and provides resistance against sidewise rotation of the ball so that the wearer has greater control over the direction and movement of the skates. Since the balls are restrained against sidewise rotation, the skates function in a manner similar to that of a conventional ice skate which can move freely in a forward direction but offers resistance against sidewise movement. Since the balls are aligned with one another, the wearer can tilt from one side to the other much like a conventional ice skate and in a manner not possible with four-wheeled roller skates. The combination of the ball and supporting rings provides a unique action. The friction factor of the ball against the skating surface will be greater than the friction of the ball against the rings so that when the wearer tilts his body and turns to stop, the skate will be perpendicular to his line of travel. Under this condition, the balls will rotate against the rings sidewise to bring the wearer to a controlled stop.

To reduce wear on the ball, the edges of the rings may be rounded to prevent their cutting into the surface of the ball. The rings may be of various materials, including metal and plastic such as nylon or Teflon which are tough and durable and provide good rolling action with low friction characteristics. The sleeves 44 and 46 preferably are made of a low friction material and for this purpose Teflon or nylon are suitable.

In order to distribute the load of the ball more evenly, especially in the vertical direction, the single small ring 30 is mounted in spaced relation to the ball 16 directly above the axis of rotation of the ball 16 when the skate is rolling forward and backward. The ring 30 is relatively short, typically ⅝" long and ⅝" in diameter, and may be positioned between the front and rear roller support assemblies 26 and 28. In this fashion the load on the ball is more evenly distributed to prevent distortion of the ball and possible binding.

The forward end of the housing 12 is provided with a bumper 52 of rubber, or the like, by means of which the wearer can push off from a stop position by tilting the skate downwardly until the bumper engages the floor, road or the like.

Figure 6:
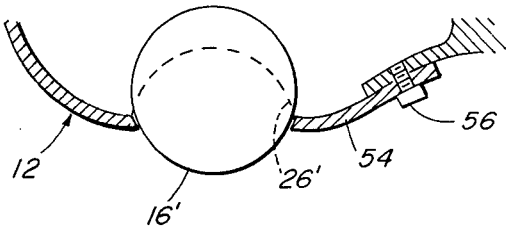
FIG. 6 is a view similar to FIG. 3 showing a modification of the invention.

Referring now more particularly to FIG. 6 of the drawings, there is shown means for replacing the ball 16' in the event that the ball wears out after a period of extended use. In FIG. 6, the housing 12' is provided with a removable plate 54 adjacent each opening 26' through which the ball 16' projects. The plate 54 may be held in position as by a screw 56 or other means, and when in position, will hold the ball 16' within its socket. It will be understood that by removing the screw 56, the plate 54 may be disconnected to thereby enlarge the opening and remove the ball or service the rings as required.

While the invention has been described with particular reference to the illustrated embodiments, numerous modifications thereto will appear to those skilled in the art. For example, instead of two balls for each skate, a different number may be employed. Also, a variety of materials may be substituted in different parts of the skate and dimensions may be altered.

Having thus described the invention, what I claim and desire to obtain by Letters Patent of the United States is:

1. A skate, comprising:

(a) a frame, (b) means for attaching said frame to the foot of a person, (c) said frame defining at least a pair of downwardly open sockets, (d) a ball mounted for rotation in each of said sockets, (e) at least a pair of shafts mounted in spaced relation to said frame proximate to each socket and extending in a horizontal transverse direction with respect to the length of said frame, (f) a plurality of rings mounted for free independent rotation to at least one of said shafts and at least one ring mounted for rotation to another of said shafts, the periphery of each of said rings rotatably supporting said ball at the outer surface thereof.

2. A skate according to claim 1 wherein said sockets are located at opposite ends of said frame.

3. A skate according to claim 2 wherein a plurality of rings are mounted to two of said shafts with the rings on each shaft being of several different diameters.

4. A skate according to claim 3 wherein the outer periphery of each ring is profiled to conform with that portion of the ball in which it is in contact.

5. A skate according to claim 3 wherein the rings on each shaft are axially spaced from one another.

6. A skate according to claim 3 including a third shaft mounted to said frame above each ball and a single center ring rotatably mounted thereto.

7. A skate according to claim 1 including a removable plate mounted to said frame adjacent said socket for access to said ball.

8. A skate according to claim 1 including a resilient bumper mounted to the forward end of said frame.

9. A skate according to claim 3 wherein the peripheral edges of said rings are rounded.

10. A skate according to claim 1 wherein said means includes a shoe fixed to said frame.

* * * * *